US009849459B2

(12) United States Patent
Faure

(10) Patent No.: US 9,849,459 B2
(45) Date of Patent: Dec. 26, 2017

(54) IMPACT SCREEN FOR AN IMPACT CRUSHER, IMPACT CRUSHER PROVIDED WITH SAID IMPACT SCREEN, AND CRUSHING FACILITY

(71) Applicant: METSO MINERALS (FRANCE) SA, Macon (FR)

(72) Inventor: Thierry Jean Maurice Faure, Saint Georges de Reneins (FR)

(73) Assignee: METSO MINERALS (FRANCE) SA, Macon (FR)

( * ) Notice: Subject to any disclaimer, the term of this patent is extended or adjusted under 35 U.S.C. 154(b) by 245 days.

(21) Appl. No.: 14/648,107

(22) PCT Filed: Nov. 15, 2013

(86) PCT No.: PCT/FR2013/052752

§ 371 (c)(1),
(2) Date: May 28, 2015

(87) PCT Pub. No.: WO2014/083257

PCT Pub. Date: Jun. 5, 2014

(65) Prior Publication Data

US 2015/0298132 A1 Oct. 22, 2015

(30) Foreign Application Priority Data

Nov. 29, 2012 (FR) ..... 12 61390

(51) Int. Cl.
*B02C 13/00* (2006.01)
*B02C 13/09* (2006.01)
*B02C 13/282* (2006.01)

(52) U.S. Cl.
CPC ..... *B02C 13/095* (2013.01); *B02C 13/282* (2013.01); *B02C 13/00* (2013.01)

(58) Field of Classification Search
CPC ..... B02C 13/095; B02C 13/282
(Continued)

(56) References Cited

U.S. PATENT DOCUMENTS 3,531,055 A 9/1970 Alt
5,255,869 A 10/1993 Smith
(Continued)

FOREIGN PATENT DOCUMENTS

CH 351 555 A 1/1961
CN 2208977 Y 10/1995
(Continued)

OTHER PUBLICATIONS

Search Report Dated: N/A.
International Search Report, dated Apr. 28, 2014, from corresponding PCT application.

*Primary Examiner* — Faye Francis
(74) *Attorney, Agent, or Firm* — Ipsilon USA, LLP

(57) ABSTRACT

The impact shield (9, 10) carries a plurality of armor bodies (16) of a strongly wear resisting material. The armor bodies (16) are fixed horizontally in succession on a front side of the impact shield by a fixing element making it possible to detach them from the impact shield (9, 10) for their replacement. The impact shield (9, 10) is composed of a fixed part (21) connected to the frame (2), and a removable part (22) carrying the armor bodies (16) and making it possible to remove simultaneously all the armor bodies, fixed on the same, out of the grinding chamber (3). At least one such impact shield (9, 10) is arranged in a grinding chamber (3) of an impact grinding mill including a frame (2) further including a horizontal-axis rotor (6) provided with impactors (7) arranged regularly around its periphery.

20 Claims, 3 Drawing Sheets

(58) Field of Classification Search
USPC ..... 241/189.1, 286–288
See application file for complete search history.

(56) References Cited

U.S. PATENT DOCUMENTS

| | | | | |
|---|---|---|---|---|
| 5,513,811 | A | 5/1996 | Phan Hung | |
| 5,713,527 | A * | 2/1998 | Hemesath | B02C 13/095 241/189.1 |
| 2013/0284839 | A1 | 10/2013 | Faure | |

FOREIGN PATENT DOCUMENTS

| | | | |
|---|---|---|---|
| CN | 201189478 | Y | 2/2009 |
| CN | 102671745 | A | 9/2012 |
| DE | 20002663 | U1 | 3/2000 |
| FR | 2 970 882 | A1 | 8/2012 |
| GB | 2 020 574 | A | 11/1979 |
| GB | 2020574 | A | 11/1979 |

* cited by examiner

IMPACT SCREEN FOR AN IMPACT CRUSHER, IMPACT CRUSHER PROVIDED WITH SAID IMPACT SCREEN, AND CRUSHING FACILITY

The present invention relates to an impact shield for horizontal-rotor impact grinding mills, in particular those intended for use in quarries or mines for the size reduction of aggregate or minerals.

Impact grinding mills comprise a grinding chamber containing a horizontal rotor which is provided with impactors arranged regularly around its periphery, and at least one impact shield which, at its upper end, comprises a first link allowing it to be connected in a pivoting manner to the frame of the grinding mill. The impact shield comprises, close to its lower end, a second link allowing the shield to be connected to adjusting means comprising an adjustment actuator to move the lower end of the shield closer to or further away from the rotor, in particular in order to define, between the lower end of the lowest impact shield and the free end of the impactors, a gap R (see FIG. 1) which determines a given grain size.

In an impact grinding mill, the aggregate is introduced via a feed opening and is then hit by the impactors secured to the rotor and thrown against the impact shield or shields such that it is reduced in size. Once introduced, the aggregate undergoes this process several times until it reaches the dimension of the adjustment gap R between the end of the impactors and the lower end of the last impact shield before the aggregate leaves. Once this size has been reached, the reduced aggregate passes between the impactors and the shield and is removed toward the exit.

Impact grinding mills comprise at least one impact shield and generally at least two impact shields. A first impact shield is arranged behind the rotor and offset upward so as to define the gap R mentioned above. The second impact shield is arranged higher up, above the rotor, and forms an angle with respect to the first impact shield. When the aggregate enters the impact grinding mill, it is thrown by the impactors toward the impact shields in order to be made smaller, and finally toward the impact shield which defines the final maximum size of the aggregate depending on the gap R.

The impactors are abradable parts made of a highly wear-resistant material and they must be replaced regularly when the effective extent of their ends becomes too small with respect to the surface of the rotor.

This is also the case for the impact shields which, just like the impactors, are subjected to intense wear and therefore carry, on their front side directed toward the rotor, several abradable parts consisting of armor bodies made of a highly wear-resistant material. These armor bodies are elongate bodies fixed horizontally in succession on this front side. Their number may vary depending on the size of the impact shield and are fixed on this front side of the impact shield with the aid of fixing means which allow them to be detached from the impact shield so as to be replaced when they are too worn for correct use.

However, these armor bodies fixed to the front side of each impact shield must be mounted and removed one by one inside the grinding chamber of the grinding mill, which makes these operations complicated, also because space within the grinding chamber is relatively limited.

Impact grinding mills provided with such armor bodies are known, inter alia, from documents GB 2 020 574, CH 351 555, U.S. Pat. No. 3,531,055, and FR 2 970 882. All these documents show one-piece armor bodies which must be removed one by one.

Moreover, the mass of each armor body is considerable, which results in a certain level of risk in the operation. These operations inevitably take a lot of time, in particular when changing all of the armor bodies. Of course, the grinding mill must be at a complete stop for all this time and is entirely unproductive during this operation of replacing the armor bodies.

One aim of the invention is to alleviate the drawbacks linked to the operations of mounting and removing the armor bodies by proposing an impact shield which facilitates the operations of replacing the armor bodies, making it possible to achieve a marked reduction in the time required for these operations, which consequently greatly reduces the downtime of the grinding mill.

One object of the invention is an impact shield for an impact grinding mill having a horizontal rotor, comprising at an upper end a first link for connecting the impact shield in a pivoting manner to a frame of the impact grinding mill, and, close to a lower end, a second link for connecting the impact shield to adjusting means adapted to pivot the impact shield, the impact shield carrying a plurality of armor bodies made of a wear-resistant material, said armor bodies being fixed on the impact shield by fixing means making it possible to detach them from the impact shield for their replacement, characterized in that said impact shield consists of a fixed part connected to the frame, and a removable part carrying said armor bodies and making it possible to remove simultaneously all the armor bodies fixed on the same, out of said grinding chamber.

According to other features of the invention:

- said removable part of the impact shield is formed from a support plate provided with fixing holes for fixing the armor bodies;
- said removable part of the impact shield comprises, at one of its ends, first connection means and, at its opposite end, second connection means for connection to said fixed part of the impact shield;
- said first connection means comprise hook forming elements adapted to cooperate with a horizontal rod provided at one of the ends of said fixed part so as to make it possible for said removable part to swing so as to approach the fixed part when assembling said removable part to said fixed part, and to move it away from the fixed part when removing said removable part;
- said second connection means comprise fixing screws adapted to extend through first fixing holes provided at one of the ends of said removable part, and second fixing holes provided at one of the ends of said fixed part, said first and second fixing holes being adapted to be aligned with regard to each other when said removable part is joined to said fixed part;
- each impact shield comprises two removable parts placed side by side on said fixed part of the impact shield;
- said removable part is at an upper end provided with lifting eyelets; and
- said first connection means of said removable part are disposed at the lower end of the same, and said second connection means are disposed at the upper end of the same.

Another aim of the invention is to propose an impact grinding mill with a horizontal rotor, comprising a frame defining a grinding chamber containing a rotor provided with impactors regularly arranged on its periphery, and at least one impact shield which, on its front side directed towards the rotor, carries a plurality of armor bodies of a highly wear-resistant material, characterized in that said at least one impact shield is an impact shield which is partly fixed and partly able to move, having the features defined above.

Yet another aim of the invention is to propose a grinding plant comprising multiple impact grinding mills according to the invention. The impact grinding mills of the grinding plant are frequently placed at a certain height relative to ground level, in a relatively inaccessible location.

By virtue of the fact that the impact grinding mills of the plant are provided with impact shields according to the invention, the operation of replacing the armor bodies is made substantially easier and safer.

The grinding plant according to the invention may be static or mobile, and in this latter case it can be mounted such that it can be moved on wheels or caterpillar tracks.

Other features and advantages of the invention will emerge from the following description of a non-limiting embodiment of the invention, with reference to the appended figures, in which.

Figure 6:
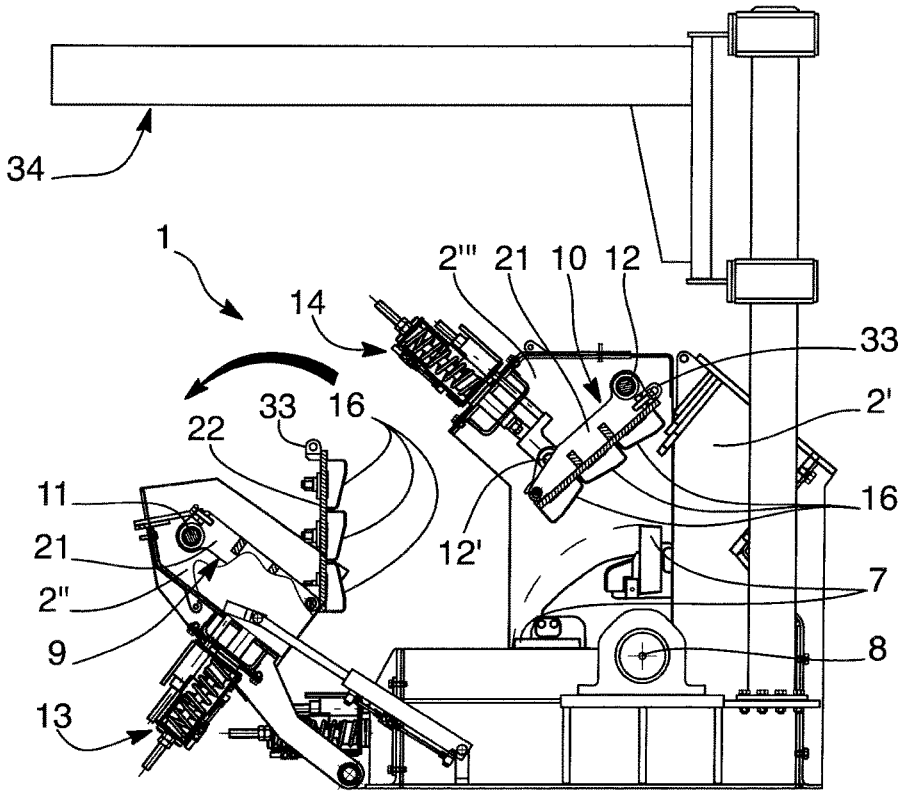
Figure 7:
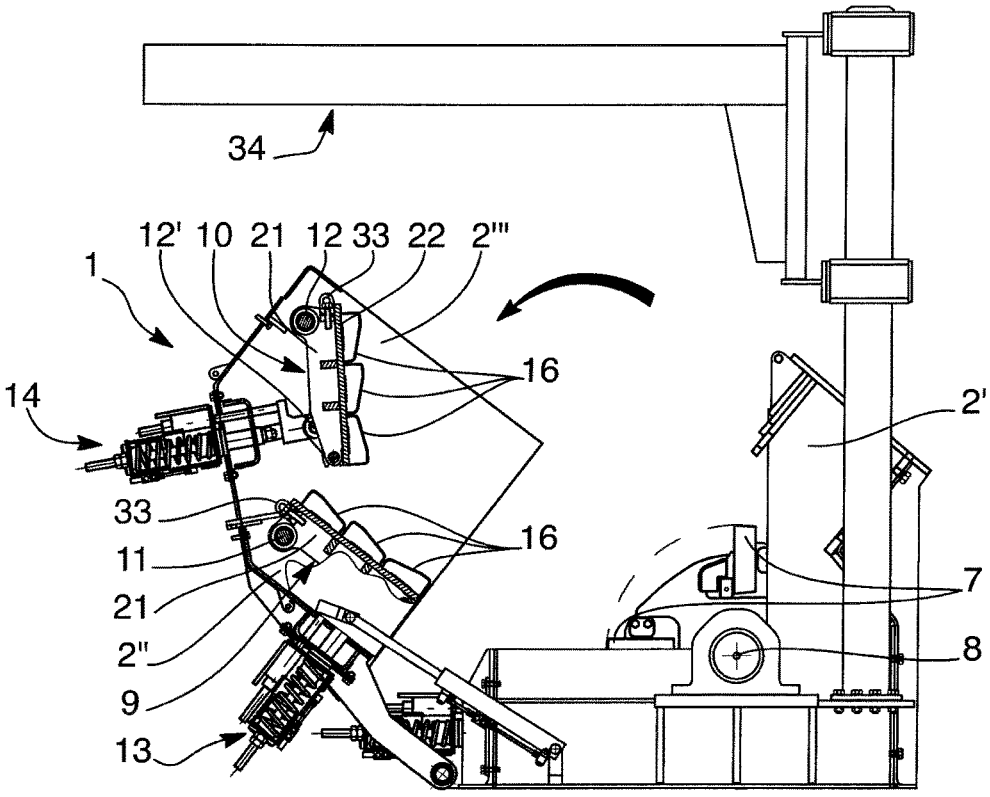
Figure 8:
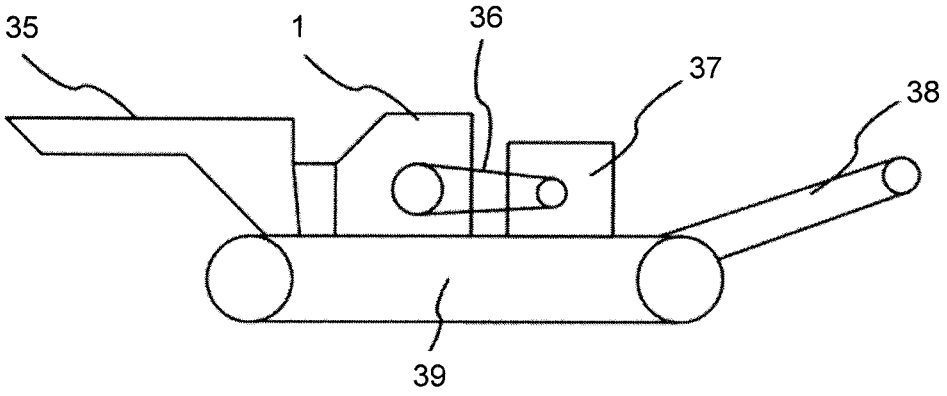

FIG. 6 is a side view, partially cut away, showing a section of the frame of the grinding mill mounted such that it is able to swing, and swung out for lifting the removable part of a first impact shield; and FIG. 7 is a side view, partially cut away, showing two sections of the frame of the grinding mill mounted such that they are able to swing, and swung out together for lifting the removable part of a second impact shield;

FIG. 8 shows a schematic view of a plant according to the invention, mounted such that it can be moved.

In the figures, identical or equivalent elements will bear the same reference signs.

Figure 1:
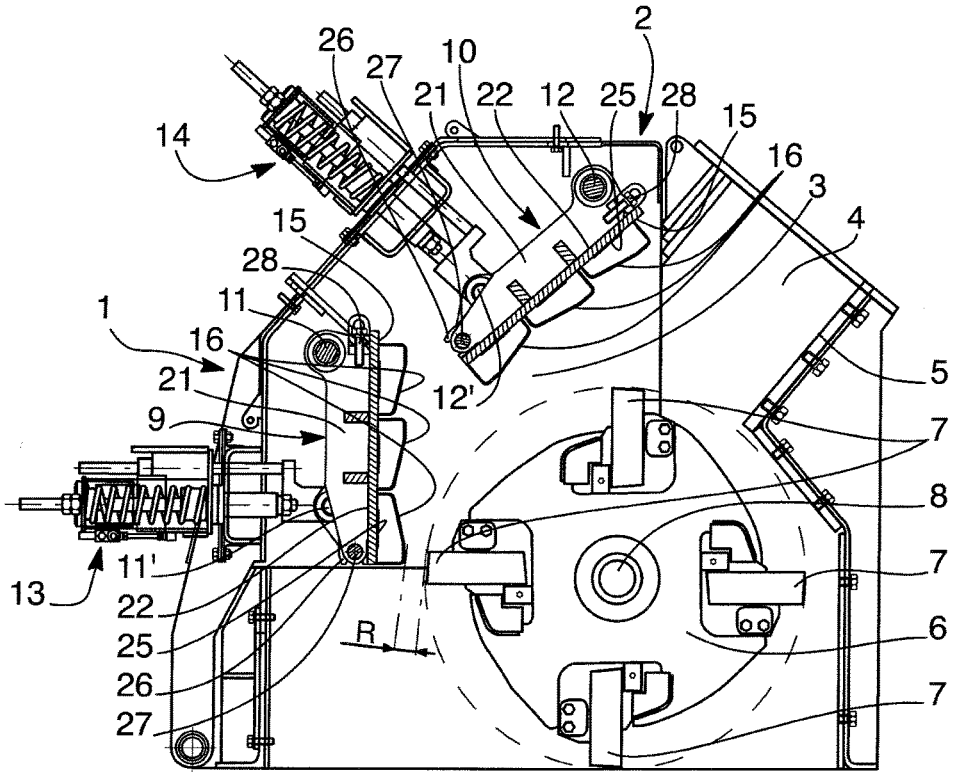
FIG. 1 is an overall side view in section showing an impact grinding mill provided with two impact shields according to the invention.

FIG. 1 shows an overall view of an impact grinding mill 1 according to the invention. It comprises a frame 2 defining a grinding chamber 3 provided with an opening 4 for receiving aggregate or minerals (not shown) which slide on a feed plate 5 which is inclined toward the interior of the grinding chamber.

The grinding chamber 3 contains a horizontal rotor carrying impactors 7, in this case four impactors, which are regularly arranged on its periphery. The rotor 6 is mounted secured with a rotation shaft 8 driven by a motor of the electric, hydraulic or any other type (not shown).

In the example shown, a first and a second impact shield 9, 10 according to the invention are arranged in the grinding chamber, the first (9) practically behind the rotor 6, offset upward, and the second (10) practically above the rotor 6, offset slightly backward. The impact shields 9, 10 comprise, at their upper end, a respective first link 11, 12 comprising a pivot so as to be able to pivot around the latter, and close to their respective lower end a second link 11', 12' connecting the impact shield to adjusting means comprising adjusting actuators 13 and, respectively, 14 by means of which it is possible to move the free end of the respective shield closer to or further from the rotor 6.

The grain size to be obtained for the material to be ground is adjusted by moving the lower end of the first shield 9, which is the lower, closer to or further from, as the case may be, the periphery of the rotor in order to obtain a gap R through which the aggregate can pass once it has reached the set size determined by this gap.

The process of adjusting the grain size is widely known and will not be described in more detail.

Each impact shield 9, 10 carries, on its front side 15 oriented toward the rotor 6, multiple elongate armor bodies 16 fixed horizontally in succession on this front side 15. In the example shown, there are three armor bodies on each impact shield 9, 10. The armor bodies are made of a highly wear-resistant material and they are attached to the respective impact shield 9, 10 with fixing means allowing them to be detached from the impact shields in order that they might be replaced.

Figure 3:
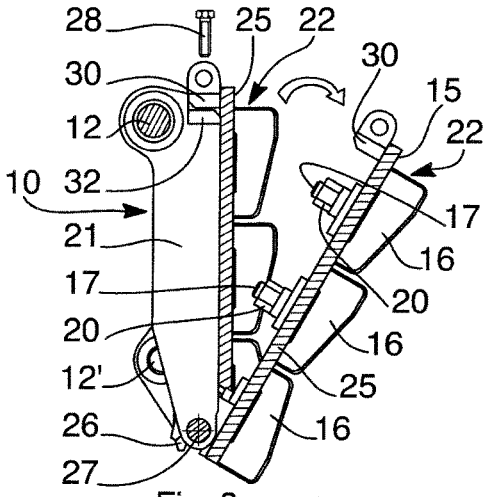
FIG. 3 is a side view showing the removable part connected to the fixed part of the impact shield and, as a dashed line, freed and swung out from the fixed part in order to be removed.
Figure 4:
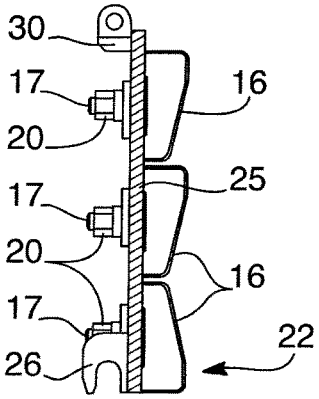
FIG. 4 is a side view of the removable part of the impact shield.

In the example shown, these means for fixing the armor bodies comprise screws 17 (see FIGS. 3 to 5) extending through through-holes 18 and 19 created in the armor bodies 16 and, respectively, in the impact shields 9, 10 and aligned with one another in order to allow the screws 17 to engage with nuts 20 arranged on the rear side of the impact shields. As a variant, the screws may be screwed directly into tapped holes (not shown) created in the impact shields in place of the through-holes 19 in the impact shields 9, 10.

According to the invention, each impact shield 9, 10 consists of a fixed part 21 connected to the frame 2 and a removable part 22 carrying the armor bodies 16. The fixed part 21 is connected to the frame 2 by means of the respective first link 11, 12 and, even though it is able to pivot, it is fixed in the sense that it is not removable, that is to say that it normally remains permanently connected to the frame 2.

The fixed part 21 of the impact shields 9, 10 consists of elongate elements 23 which cross each other so as to form an open-work structure. The removable part 22 of the impact shields 9, 10 comprises a rectangular support plate 25 provided with through-holes 19 for fixing the armor bodies 16.

The removable part 22 of the impact shields 9, 10 thus makes it possible to simultaneously remove all of the armor bodies 16 from the grinding chamber 3 while leaving the fixed part 21 in place in the grinding chamber 3.

In order to connect the removable part 22 of the impact shields 9, 10 to the fixed part 21 of the latter, the removable part 22 comprises, at one of its ends, first connecting means and, at its opposite end, second connecting means.

The first connecting means comprise hook forming elements 26 which are able to cooperate with an axis defined by a horizontal rod 27 provided at one of the ends of the fixed part 21 of the impact shields 9, 10. The hook forming elements 26 of the removable part 22 thus form, with the horizontal rod 27 of the fixed part 21, a link about which the removable part 22 is able to swing toward an assembly position with the fixed part in order to be connected to the latter with the second connecting means.

These second means for connecting the removable part 22 to the fixed part 21 comprise fixing screws 28 which are able to extend through first fixing holes 29, provided in a fixing plate 30, to one of the ends of the removable part 22, and through second fixing holes 31, provided in a fixing plate 32, to one of the ends of the fixed part 21.

When the removable part 22 swings toward its assembly position, its fixing plate 30 comes to rest on the fixing plate 32 of the fixed part 21 such that the first fixing holes 29 and second fixing holes 31 are aligned so as to receive the fixing screws 28 which, on the rear side of the impact shields 9, 10, cooperate with the second fixing holes 31 which are advantageously tapped. According to one variant, which is not shown, fixing nuts are permanently fixed on the rear face of the impact shields 9, 10, in line with the second fixing holes 31.

The first connecting means comprising the hook forming elements 26 are preferably arranged at the lower end of the removable part 22, and the second connecting means comprising the fixing screws 28 and the first and second fixing holes 29, 31 are arranged at the upper end of the removable part 22 in order to make sure that the screws are as accessible as possible, as is shown in the figures.

However, this arrangement of the first and second means for connecting the removable part 22 to the fixed part 21 of the impact shields 9, 10 can be reversed, that is to say that the first connecting means comprising the hook forming elements 26 are arranged at the upper end of the removable part 22, and the second connecting means comprising the fixing screws 28 and the first and second fixing holes 29, 31 are arranged at the lower end of the removable part 22. In this case, the horizontal rod 27 which, in the example shown, is arranged at the bottom of the fixed part 21, is of course arranged at the top of the fixed part.

In order to make it easier to handle the removable part 22 of the impact shields 9, 10, this removable part comprises, at its upper end, lifting eyelets 33 which are able to receive the hooks (not shown) of a lifting device 34 provided with a suitable bracket on the grinding mill. Otherwise, the removable part can be lifted using any other lifting means, which may be fixed, such as a travelling crane, or removable, such as a crane.

Figure 2:
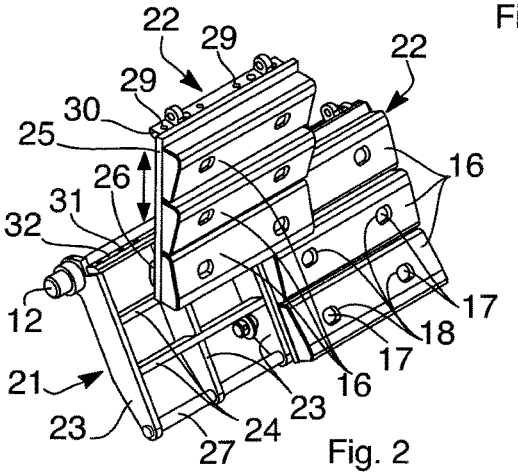
FIG. 2 is a perspective view showing an impact shield according to the invention comprising a fixed part and two removable parts, one of which is in the process of being removed.

In order to make it easier still to handle the removable part 22, the latter is divided into two removable parts 22, as shown in FIG. 2. Thus, the weight of the assembly of each removable part with the corresponding armor body 16 is divided in two.

By virtue of the invention, it is thus possible to remove, together, all the armor bodies 16 fixed to the removable part 22 without it being necessary to remove the armor bodies one by one, which would result in large and very laborious operations requiring a lot of time within the grinding chamber 3 of the impact grinding mill 1.

In order to provide easy access for lifting the removable part 22 of the impact shields 9, 10 using the lifting device 34, the frame 2 of the grinding mill 1 comprises a fixed frame section 2' and at least one frame section 2" mounted such that it can swing to open the grinding chamber 3 upward (see FIG. 6). By virtue of this arrangement, the removable part 22 of the first impact shield 9 can be lifted substantially vertically and transposed for changing the armor bodies 16.

In order to provide access to the second impact shield 10 for substantially vertical lifting using this same lifting device 34, the frame of the grinding mill advantageously comprises a third frame section 2'" which is mounted such that it can swing with the frame section 2" (see FIG. 7).

By virtue of the invention, the removable part 22 of the impact shields 9, 10 can easily be dismantled making it possible to remove simultaneously all of the armor bodies 16, fixed to the support plate 25, outside the grinding chamber.

In order to detach the removable part 22 from the fixed part 21 of the impact shields 9, 10, it is merely necessary to unscrew the fixing screws 28, connect the eyelets 33 to the hooks of a lifting device 34 and, when the removable part 22 is lifted, this latter part is pivoted slightly about the axis formed by the horizontal rod 27 of the fixed part 21 while it remains engaged by virtue of this arrangement until the point at which the removable part is lifted out of the grinding chamber 3. This operation is quick to carry out.

The removable part 22 of the impact shield 9, 10 is preferably transferred into a workshop having an environment better suited to the removal of the armor bodies 16. For this removal, the removable part 22 is preferably arranged in a horizontal position (see FIG. 5), for example on trestles. This substantially reduces the intervention time.

Furthermore, the downtime of the grinding mill can be limited to the time needed for replacing a removable part 22 as a unit if a new removable part with new armor blocks 16 is prepared in advance, which represents the best possible solution.

The horizontal-shaft impact grinding mill according to the invention comprises at least one impact shield consisting of a fixed part connected to the frame 2 and a movable part carrying the armor bodies 16.

The grinding plant according to the invention comprises at least one and preferably several horizontal-shaft impact grinding mills 1 comprising at least one impact shield consisting of a fixed part connected to the frame 2 and a movable part carrying the armor bodies 16.

The plant can be static or movable and, in this latter case, the impact grinding mills according to the invention are mounted such that they can be moved on wheels, possibly along rails, or on caterpillar tracks.

FIG. 8 shows an impact grinding mill 1 which forms part of a plant according to the invention. This impact grinding mill 1 is connected on one hand to a feed device 35 and on the other hand, via the intermediary of transmission means 36, to a device 37 for driving in rotation the rotor of the impact grinding mill. This device for driving in rotation can be an electric motor and/or a diesel engine. A transporter 38 is arranged downstream of the impact grinding mill for removing the ground material.

Figure 5:
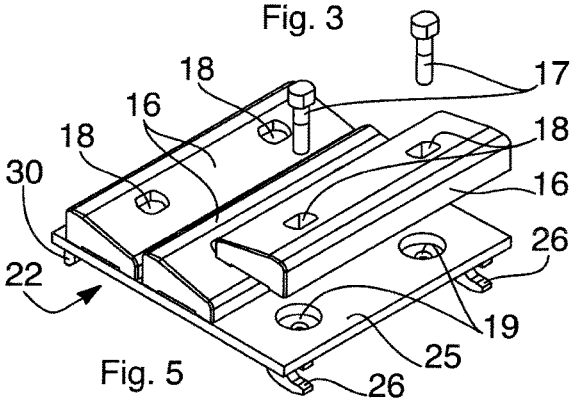
FIG. 5 is a perspective view showing the removable part of the impact shield in a horizontal position for changing the armor bodies.

Finally, FIG. 5 shows that this installation is made mobile in that it is mounted on caterpillar tracks 39.

Of course, the invention is not limited to those examples which have been illustrated and described, and a person skilled in the art will be able to find variants without in so doing departing from the scope of the invention.

The invention claimed is:

1. Impact shield for an impact grinding mill, said grinding mill containing a horizontal rotor having at an upper end a first link for connecting the impact shield in a pivoting way to a frame of the impact grinding mill, said frame defining a grinding chamber, and, near to an lower end, a second link for connecting the impact shield to adjusting means adapted to pivot the impact shield, said impact shield comprising:

a plurality of armor bodies of a strongly wear resisting material, said armor bodies being fixed on said impact shield by fixing means making it possible to detach them from the impact shield for their replacement, wherein said impact shield is composed of a fixed part connectable to the frame, and a removable part carrying the armor bodies and making it possible to remove simultaneously all the armor bodies fixed on the same, out of said grinding chamber.

2. Impact shield as claimed in claim 1, wherein the removable part of the impact shield is formed from a support plate provided with fixation holes for fixing the armor bodies.

3. Impact shield as claimed in claim 1, wherein said removable part of the impact shield is at one end thereof provided with first connection means and at an opposite end provided with second connection means for connection to said fixed part of the impact shield.

4. Impact shield as claimed in claim 3, wherein said first connection means comprise hook forming elements adapted to cooperate with a horizontal rod provided at one of the ends of said fixed part so as to make it possible for the removable part to swing to approach the fixed part when assembling said removable part to said fixed part, and to move the removable part away from the fixed part when removing said removable part.

5. Impact shield as claimed in claim 3, wherein said second connection means comprise fixation screws adapted to extend through first fixation holes provided at one of the ends of said removable part, and second fixation holes provided at one of the ends of said fixed part, said first and second fixation holes being adapted to be aligned with regard to each other when said removable part is joined to said fixed part.

6. Impact shield as claimed in claim 1, wherein the impact shield comprises two removable parts placed side by side on said fixed part of the impact shield.

7. Impact shield as claimed in claim 1, wherein said removable part is at an upper end provided with lifting eyelets.

8. An impact grinding mill having an impact shield as claimed in claim 3, wherein said first connection means of said removable part are disposed at the lower end of the same, and said second connection means are disposed at the upper end of the same.

9. An impact grinding mill with a horizontal rotor, comprising a frame (2) defining a grinding chamber (3) containing a horizontal rotor (6) provided with impactors (7) regularly disposed on a periphery, and at least one impact shield (9, 10) which on a front side (15) directed towards the rotor (6) carries a plurality of armor bodies (16) of a strongly wear resisting material, wherein said at least one impact shield (9, 10) is an impact shield as claimed in claim 1.

10. A grinding plant, comprising at least one impact grinding mill as claimed in claim 9.

11. A grinding plant as claimed in claim 10, wherein said grinding plant is stationary or mobile.

12. Impact shield as claimed in claim 2, wherein said removable part of the impact shield is at one end thereof provided with first connection means and at an opposite end provided with second connection means for connection to said fixed part of the impact shield.

13. Impact shield as claimed in claim 4, wherein said second connection means comprise fixation screws adapted to extend through first fixation holes provided at one of the ends of said removable part, and second fixation holes provided at one of the ends of said fixed part, said first and second fixation holes being adapted to be aligned with regard to each other when said removable part is joined to said fixed part.

14. Impact shield as claimed in claim 2, wherein the impact shield comprises two removable parts placed side by side on said fixed part of the impact shield.

15. Impact shield as claimed in claim 3, wherein the impact shield comprises two removable parts placed side by side on said fixed part of the impact shield.

16. Impact shield as claimed in claim 4, wherein the impact shield comprises two removable parts placed side by side on said fixed part of the impact shield.

17. Impact shield as claimed in claim 5, wherein the impact shield comprises two removable parts placed side by side on said fixed part of the impact shield.

18. Impact shield as claimed in claim 2, wherein said removable part is at an upper end provided with lifting eyelets.

19. Impact shield as claimed in claim 3, wherein said removable part is at an upper end provided with lifting eyelets.

20. Impact shield as claimed in claim 4, wherein said removable part is at an upper end provided with lifting eyelets.

* * * * *